US010767396B2

(12) United States Patent
Distefano et al.

(10) Patent No.: US 10,767,396 B2
(45) Date of Patent: Sep. 8, 2020

(54) VEHICULAR LATCH ASSEMBLY WITH LATCH MECHANISM HAVING POP-OFF SOUND REDUCTION

(71) Applicant: Magna Closures Inc., Newmarket (CA)

(72) Inventors: John Distefano, Richmond Hill (CA); Ioan Dorin Ilea, Vaughan (CA)

(73) Assignee: MAGNA CLOSURES INC., Newmarket (CA)

( * ) Notice: Subject to any disclaimer, the term of this patent is extended or adjusted under 35 U.S.C. 154(b) by 384 days.

(21) Appl. No.: 15/673,503

(22) Filed: Aug. 10, 2017

(65) Prior Publication Data

US 2018/0044950 A1 Feb. 15, 2018

Related U.S. Application Data

(60) Provisional application No. 62/375,187, filed on Aug. 15, 2016.

(51) Int. Cl.

| | |
|---|---|
| ***E05B 77/36*** | (2014.01) |
| ***E05B 81/14*** | (2014.01) |
| ***E05B 81/00*** | (2014.01) |
| ***E05B 83/36*** | (2014.01) |
| ***E05B 85/24*** | (2014.01) |
| ***E05B 85/26*** | (2014.01) |
| ***E05C 3/12*** | (2006.01) |
| *E05B 81/06* | (2014.01) |
| *E05B 79/12* | (2014.01) |
| *E05B 79/20* | (2014.01) |

(52) U.S. Cl.

CPC ..... *E05B 77/36* (2013.01); *E05B 81/00* (2013.01); *E05B 81/14* (2013.01); *E05B 83/36* (2013.01); *E05B 85/243* (2013.01); *E05B 85/26* (2013.01); *E05C 3/12* (2013.01); *E05B 79/12* (2013.01); *E05B 79/20* (2013.01); *E05B 81/06* (2013.01)

(58) Field of Classification Search

CPC ..... E05B 77/36; E05B 77/38; E05B 77/42; E05B 81/00; E05B 81/06; E05B 81/14; E05B 83/36; E05B 85/243; E05B 85/20; E05B 85/26; E05B 85/24; E05B 79/12; E05B 79/10; E05B 79/14; E05B 79/16; E05B 79/18; E05B 79/20; E05C 3/12

USPC ..... 292/229

See application file for complete search history.

(56) References Cited

U.S. PATENT DOCUMENTS

| | | | | |
|---|---|---|---|---|
| 9,512,651 | B2 * | 12/2016 | Taurasi | E05B 15/04 |
| 2014/0091581 | A1 * | 4/2014 | Taurasi | E05B 15/04 292/215 |
| 2015/0368934 | A1 * | 12/2015 | Tomaszewski | B60Q 9/00 292/199 |

FOREIGN PATENT DOCUMENTS

| | | | | |
|---|---|---|---|---|
| EP | 0978609 | A1 | 2/2000 | |
| EP | 1176273 | A2 | 1/2002 | |
| WO | WO-2014000084 | * | 1/2014 | B60Q 9/00 |

* cited by examiner

*Primary Examiner* — Nathan Cumar

(74) *Attorney, Agent, or Firm* — Dickinson Wright PLLC

(57) ABSTRACT

A closure latch assembly for use in a motor vehicle closure system for releasably latching a vehicle door to a vehicle body. The closure latch assembly includes a latch mechanism providing a pop-off sound reduction function.

26 Claims, 10 Drawing Sheets

VEHICULAR LATCH ASSEMBLY WITH LATCH MECHANISM HAVING POP-OFF SOUND REDUCTION

CROSS-REFERENCE TO RELATED APPLICATIONS

This application claims the benefit of U.S. Provisional Application No. 62/375,187 filed Aug. 15, 2016. The entire disclosure of the above application is incorporated herein by reference.

FIELD

The present disclosure relates generally to closure latch assemblies for use in motor vehicle closure systems. More particularly, the present disclosure is directed to a closure latch assembly for a closure panel and which is equipped with a latch mechanism providing a pop-off sound reduction function.

BACKGROUND

This section provides background information related to the present disclosure which is not necessarily prior art.

In view of increased consumer demand for motor vehicles equipped with advanced comfort and convenience features, many modern motor vehicles are now provided with keyless passive entry systems to permit locking and release of closure panels (i.e., doors, tailgates, liftgates and decklids) without use of a traditional key-type entry system. In this regard, popular features now available with many vehicle closure latch systems include power locking/unlocking and power release functionality. These "powered" features are typically provided by a closure latch assembly mounted to the closure panel and which includes a ratchet and pawl type of latch mechanism controlled via at least one electric actuator. In operation, the closure panel is latched in a closed position by virtue of a ratchet being positioned in a striker capture position to releaseably retain a striker that is mounted to a structural portion of the vehicle. The ratchet is held in its striker capture position by a pawl engaging the ratchet, when the pawl is located in a ratchet holding position. The closure latch assembly is operated in a "latched" mode when the pawl is located in its ratchet holding position. To release the closure panel from its closed position, the electric actuator is actuated to move the pawl from its ratchet holding position into a ratchet releasing position, whereby a ratchet biasing arrangement forcibly pivots the ratchet from its striker capture position into a striker release position so as to release the striker. The closure latch assembly is operating in an "unlatched" mode when the pawl is located in its ratchet releasing position. As an alternative to such single ratchet/pawl latch mechanisms, it is also known to employ a double ratchet/pawl type of latch mechanism within the closure latch assembly to reduce the release effort required for the electric actuator to release the latch mechanism during a power release operation.

To ensure that precipitation and road debris do not enter the vehicle, vehicle closure panels are equipped with weather seals around their peripheral edge and which are configured to seal against a mating surface of the vehicle body surrounding the closure opening. These weather seals also function to reduce wind noise. The weather seals are typically made from an elastomeric material and are configured to compress upon closing and latching of the closure panel by virtue of the closure latch assembly. As is recognized, increasing the compressive clamping force applied to the weather seals provides improved noise reduction within the passenger compartment. However, with the weather seals held in a highly compressed condition, they tend to force the closure panel toward its open position and this "opening" force is resisted by the latch mechanism of the closure latch assembly. Because the seal loads exerted on the latch mechanism are increased, the forces required to release the latch mechanism are also increased which, in turn, impacts the size and power requirements of the electric actuator. Further, an audible "pop-off" sound is sometimes generated following actuation of the electric actuator during the power release operation due to the quick release of the seal loads as the striker engages the ratchet of the latch mechanism as the ratchet is driven toward its striker release position.

To address this dichotomy between high seal loads and low release efforts, it is known to provide an arrangement for controllably releasing the seal loading in coordination with release of the latch mechanism. For example, European Publication No. EP1176273 discloses a single ratchet/double pawl type of power-operated latch mechanism that is configured to provide a progressive releasing of the ratchet for reducing noise associated with its release. In addition, European Publication EP0978609 utilizes an eccentric mechanism in association with a single ratchet/pawl type of latch mechanism to reduce seal loads prior to release of the ratchet.

While current closure latch assemblies are sufficient to meet regulatory requirements and provide enhanced comfort and convenience, a need still exists to advance the technology and provide alternative closure latch assemblies and arrangements that address and overcome at least some of the known shortcomings, particularly elimination of pop-off noise.

SUMMARY

This section provides a general summary of the disclosure, and is not intended to be a comprehensive and exhaustive listing of all features, aspects, objectives and embodiments associated with the full scope of protection afforded to the inventive concepts of the present disclosure.

It is an aspect of the present disclosure to provide a closure latch assembly for use with a closure panel associated with a motor vehicle closure system providing a mechanism for reducing the pop-off sound attributable to seal loads upon release of the closure latch assembly.

It is a related aspect of the present disclosure to provide a closure latch assembly having a latch mechanism operable for releaseably latching a striker in a striker capture position in response to movement of the closure panel from an open position to a fully-closed position, and a pop-off sound reduction mechanism configured to provide opening resistance upon initial release of the latch mechanism so as to reduce exit velocity and acceleration characteristics of the striker as it exits the closure latch assembly.

It is another related aspect of the present disclosure to equip the closure latch assembly with a ratchet/pawl type of latch mechanism and configure the pop-off sound reduction mechanism to interact with the ratchet so as to exert a resistive force on the ratchet arranged to counteract seal loads exerted on the ratchet by the striker.

In accordance with these and other aspects, the present disclosure is directed to a closure latch assembly for a closure panel mounted to a motor vehicle for movement between an open position and closed position. The closure latch assembly, comprises: a latch mechanism having a ratchet and a pawl, the ratchet being moveable between a striker release position whereat the ratchet is positioned to retain the striker, the ratchet being biased toward its striker release position, the pawl being moveable between a ratchet releasing position whereat the pawl is positioned to permit the ratchet to move to its striker release position and a ratchet holding position whereat the pawl is positioned to hold the ratchet in its striker capture position, the pawl being biased toward its ratchet holding position; and a pop-off sound reduction mechanism having an auxiliary pawl and a striker lever, the auxiliary pawl being moveable between a ratchet disengaged position whereat the auxiliary pawl is disengaged from the ratchet and a ratchet engaged position whereat the auxiliary pawl is engaged with the ratchet, the auxiliary pawl being biased toward its ratchet engaged position, the striker lever being moveable between a striker disengaged position whereat the auxiliary pawl is held in its ratchet disengaged position and a striker engaged position whereat the auxiliary pawl is permitted to move to its ratchet engaged position, the striker lever being biased toward its striker disengaged position. The striker lever moves from its striker disengaged position into its striker engaged position in response to the striker engaging and moving the ratchet from its striker release position into its striker capture position. A striker exit force exerted on the ratchet by the striker when the ratchet is located in its striker capture position is counteracted by a resistive force exerted on the ratchet and caused by engagement between the ratchet and the auxiliary pawl when the auxiliary pawl is located into its ratchet engaged position in response to movement of the striker lever to its striker engaged position.

The latch mechanism associated with the closure latch assembly is operable in a latched state when the pawl is located in its ratchet holding position for holding the ratchet in its striker capture position. The latch mechanism is further operable in an unlatched state when the pawl is moved to its ratchet releasing position for permitting movement of the ratchet to its striker release position. The closure latch assembly further comprising a latch release mechanism for moving the pawl from its ratchet holding position to its ratchet releasing position to shift the latch mechanism from its latched state into its unlatched state. The pop-off sound reduction mechanism is operable in an engaged state when the striker lever is moved by the striker to its striker engaged position and the auxiliary pawl is moved to its ratchet engaged position. The pop-off sound reduction mechanism is also operable in a disengaged state when the striker lever is located in its striker disengaged position and the auxiliary pawl is held in its ratchet disengaged position.

When the latch mechanism is in its latched state and the pop-off sound reduction mechanism is in its engaged state, an auxiliary pawl spring acting on the auxiliary pawl applies the resistive force to the ratchet such that subsequent movement of the pawl to its ratchet releasing position acts to shift the latch mechanism into its unlatched mode for causing the ratchet to forcibly move the auxiliary pawl from its ratchet engaged position into its ratchet disengaged position in response to movement of the ratchet toward its striker release position so as to shift the pop-off sound reduction mechanism into its disengaged state.

In the closure latch assembly of the present disclosure, the pop-off sound reduction mechanism further includes a memory lever moveable between an auxiliary pawl released position and an auxiliary pawl hold position. The memory lever is biased toward its auxiliary pawl hold position. Movement of the striker lever from its striker disengaged position into its striker engaged position causes the memory lever to move from its auxiliary pawl hold position to its auxiliary pawl released position for permitting the auxiliary pawl to move from its ratchet disengaged position into its ratchet engaged position. Movement of the ratchet from its striker capture position to its striker release position causes the auxiliary pawl to move from its ratchet engaged position to its ratchet disengaged position. The memory lever is operable in its auxiliary pawl hold position to hold the auxiliary pawl in its ratchet disengaged position.

In accordance with one embodiment of the present disclosure, the closure latch assembly comprises: a ratchet moveable between a striker release position whereat the ratchet is positioned to receive a striker and a striker capture position whereat the ratchet is positioned to retain the striker; a ratchet spring for biasing the ratchet toward its striker release position; a pawl moveable between a ratchet holding position whereat the pawl is positioned to hold the ratchet in its striker capture position and a ratchet releasing position whereat the pawl is positioned to permit the ratchet to move toward its striker release position; a pawl spring for biasing the pawl toward its ratchet holding position; an auxiliary pawl moveable between a ratchet engaging position whereat a cam surface on the auxiliary pawl engages a ratchet segment of the ratchet and a ratchet disengaging position whereat the cam surface is disengaged from the ratchet segment; an auxiliary pawl spring biasing the auxiliary pawl toward its ratchet engaged position; a memory lever moveable between an auxiliary pawl hold position whereat the memory lever is positioned to hold the auxiliary pawl in its ratchet disengaged position and an auxiliary pawl released position whereat the memory lever permits the auxiliary pawl to move to its ratchet engaged position; a memory lever spring biasing the memory lever toward its auxiliary pawl hold position; a striker lever moveable between a striker disengaged position whereat the striker lever positions the memory lever in its auxiliary pawl hold position and a striker engaged position whereat the striker lever positions the auxiliary pawl in its auxiliary pawl released position; and a striker lever spring biasing the striker lever toward its striker disengaged position. The striker lever moves from its striker disengaged position to its striker engaged position in response to the striker engaging and moving the ratchet from its striker release position into its striker capture position. A striker exit force exerted by the striker on the ratchet when the ratchet is held in its striker capture position is counteracted by a resistive force exerted by the auxiliary pawl spring between the cam surface on the auxiliary pawl and the ratchet segment on the ratchet when the auxiliary pawl is located ratchet engaged position.

The closure latch assembly of the present disclosure establishes a latched state between the ratchet and the pawl when the pawl is located in its ratchet holding position for holding the ratchet in its striker capture position, and an unlatched state between the ratchet and the pawl when the pawl is moved to its ratchet releasing position. An engaged state is established between the ratchet and the auxiliary pawl when the ratchet is located in its striker capture position and the auxiliary pawl is located in its ratchet engaging position, and a disengaged state is established between the ratchet and the auxiliary pawl when the ratchet moves a predetermined distance from its striker capture position toward its striker release position which causes the auxiliary pawl to move from its ratchet engaged position to its ratchet disengaged position in opposition to the biasing of the auxiliary pawl spring. The resistive force is applied to the ratchet during the predetermined distance required to shift into the unlatched and disengaged states. The cam surface on the auxiliary pawl has a positive back-out profile configured to generate the resistive force as the auxiliary pawl is moved by the ratchet from its ratchet engaged position to its ratchet disengaged position.

In accordance with another embodiment of the present disclosure, there is provided a closure latch assembly for a closure panel mounted to a motor vehicle for movement between an open position and closed position. The closure latch assembly includes a latch mechanism having a ratchet and a pawl, the ratchet being moveable between a striker release position whereat the ratchet is positioned to receive a striker and a striker capture position whereat the ratchet is positioned to retain the striker, the ratchet being biased toward its striker release position, the pawl being moveable between a ratchet releasing position whereat the pawl is positioned to permit the ratchet to move to its striker release position and a ratchet holding position whereat the pawl is positioned to hold the ratchet in its striker capture position, the pawl being biased toward its ratchet holding position. The closure latch assembly also includes a ratchet motion reduction mechanism having an auxiliary pawl being moveable between a ratchet disengaged position whereat the auxiliary pawl is disengaged from the ratchet and a ratchet engaged position whereat the auxiliary pawl is engaged with the ratchet, the auxiliary pawl being biased toward its ratchet engaged position. A striker exit force exerted on the ratchet by the striker when the ratchet is located in its striker capture position is counteracted by a resistive force exerted on the ratchet by the auxiliary pawl as the auxiliary pawl is moved from its ratchet engaged position to its ratchet disengaged position in response to movement of the ratchet from its striker capture position and striker release position.

In accordance with another embodiment of the present disclosure, the ratchet includes a ratchet extension segment configured to engage a cam surface on the auxiliary pawl when the ratchet is located in its striker capture position and the auxiliary pawl is located in its ratchet engaged position, wherein the resistive force counteracts a cam-out force of the ratchet extension segment on the cam surface.

In accordance with another embodiment of the present disclosure, the auxiliary pawl is rotatable about an auxiliary pawl axis, and wherein the cam surface includes a positive cam-out profile configured to generate a rotation of the auxiliary pawl as the ratchet extension segment engages the cam surface to move the auxiliary pawl from its ratchet engaged position to its ratchet disengaged position.

In accordance with another embodiment of the present disclosure, the closure latch assembly further includes an auxiliary pawl spring biasing the auxiliary pawl toward its ratchet engaged position, wherein the resistive force further includes a force exerted by the auxiliary pawl spring opposing the movement of the auxiliary pawl from its ratchet engaged position to its ratchet disengaged position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations such that the drawings are not intended to limit the scope of the present disclosure.

Figure 7:
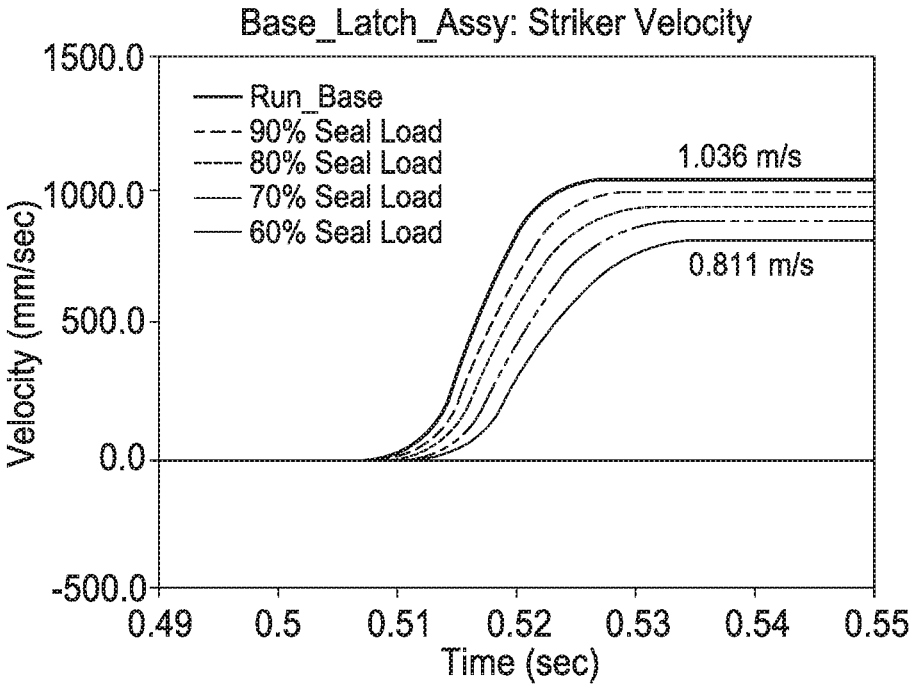
Figure 8:
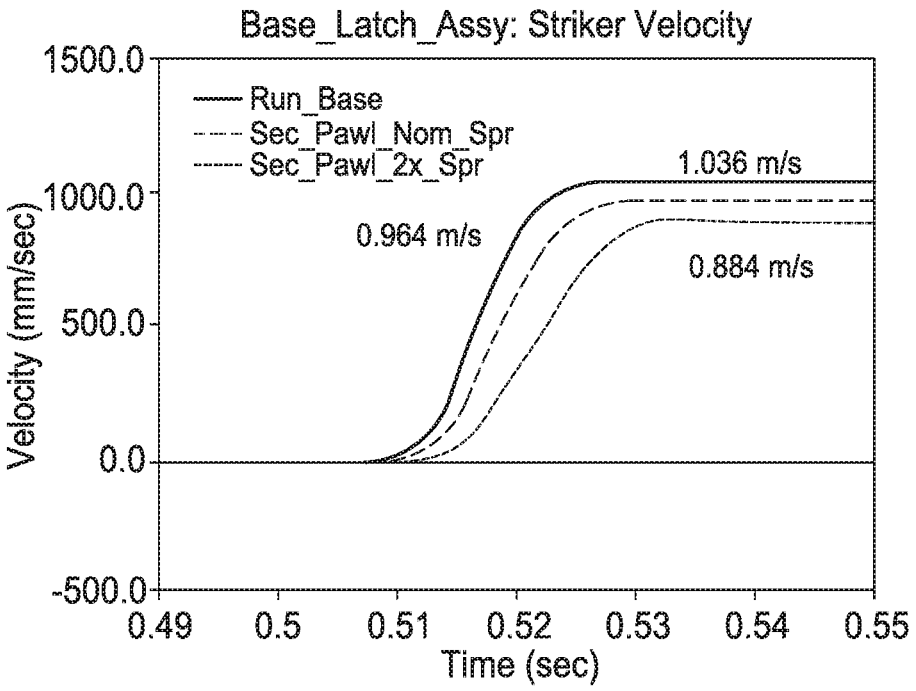
Figure 9:
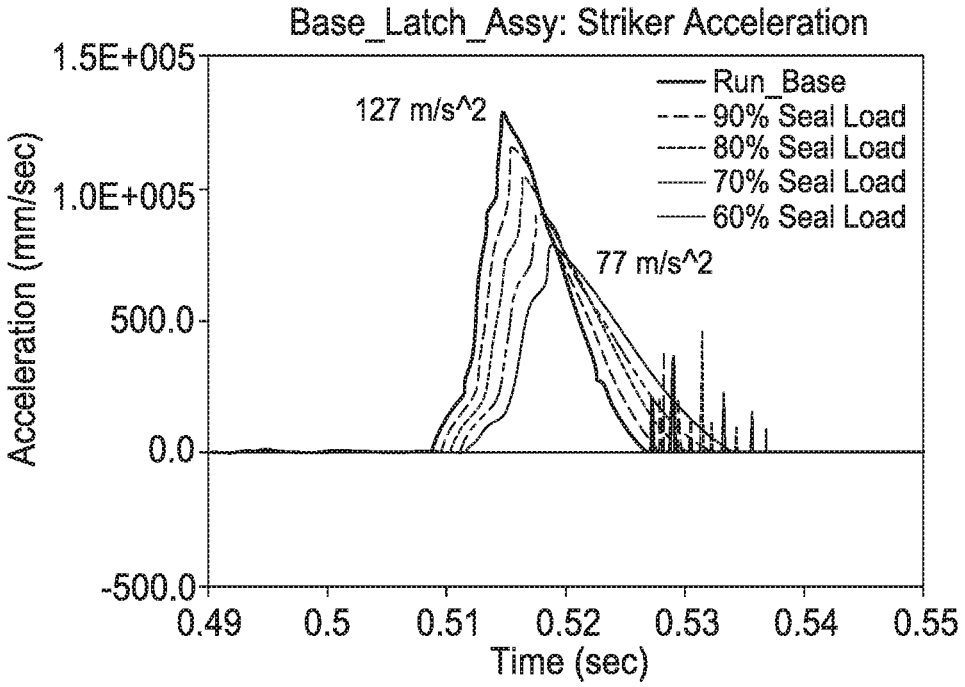
Figure 10:
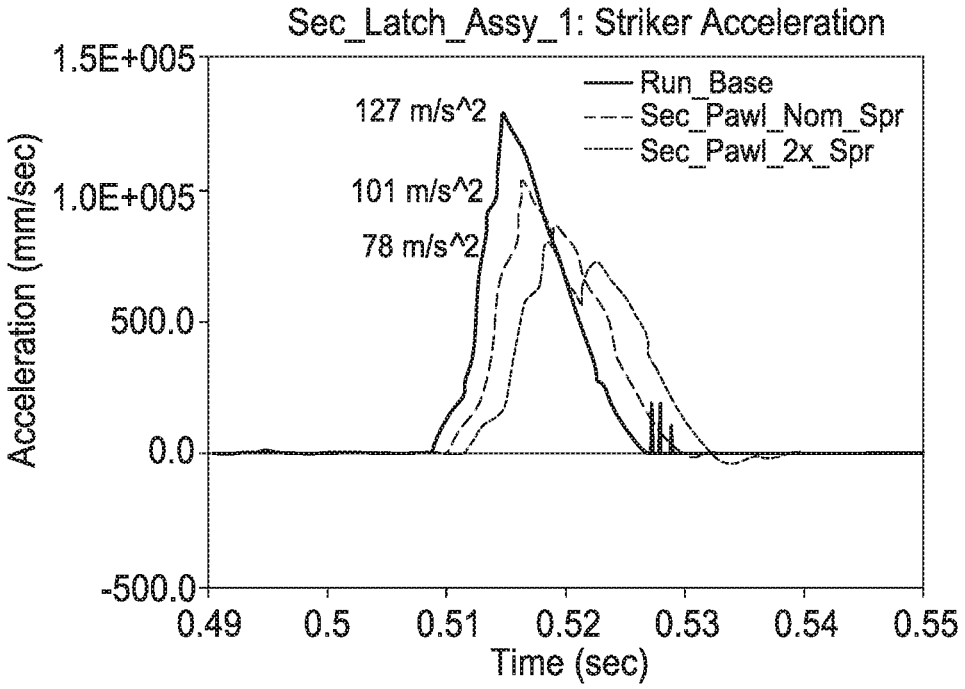

FIGS. 7 and 8 graphically illustrate various plots of an exit striker velocity characteristic comparing a latch mechanism without the pop-off sound reduction mechanism (FIG. 7) and with the pop-off sound reduction mechanism (FIG. 8) to provide an exemplary comparison showing the improvement provided by the closure latch assembly of the present disclosure; and FIGS. 9 and 10 graphically illustrate various plots of an exit striker acceleration characteristic comparing a latch mechanism without the pop-off sound reduction mechanism (FIG. 9) and with the pop-off sound reduction mechanism (FIG. 10) to provide an exemplary comparison showing the improvement provided by the closure latch assembly of the present disclosure.

Corresponding reference numerals indicate corresponding components throughout the several views of the drawings.

DETAILED DESCRIPTION

An example embodiment of a closure latch assembly providing a pop-off sound reduction feature will now be described more fully with reference to the accompanying drawings. To this end, the example embodiment is provided so that this disclosure will be thorough, and will fully convey its intended scope to those who are skilled in the art. Accordingly, numerous specific details are set forth such as examples of specific components, devices, and methods, to provide a thorough understanding of the embodiment of the present disclosure. However, it will be apparent to those skilled in the art that specific details need not be employed, that example embodiments may be embodied in many different forms, and that neither should be construed to limit the scope of the present disclosure. In the example embodiment, well-known processes, well-known device structures, and well-known technologies are not described in detail.

The terminology used herein is for the purpose of describing a particular example embodiment only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order or sequence of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms "first", "second", "third", etc. may be used herein to describe various elements, components, regions, layers, positions and/or sections, these elements, components, regions, layers, positions and/or sections should not be limited by these terms. These terms may be only used to distinguish one element, component, region, layer, position or section from another region, layer, position or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

In the following detailed description, the expression "closure latch assembly" will be used to generally indicate any manually-actuated or power-operated latch device adapted for use with a vehicle closure panel to provide a noise reducing function with or without a power release feature. Additionally, the expression "closure panel" will be used to indicate any element moveable between an open position and at least one closed position, respectively opening and closing an access opening to an inner compartment of a motor vehicle and therefore includes, without limitations, decklids, tailgates, liftgates, bonnet lids, and sunroofs in addition to the swinging and/or sliding side passenger doors of a motor vehicle to which the following description will make explicit reference, purely by way of example.

Figure 1:
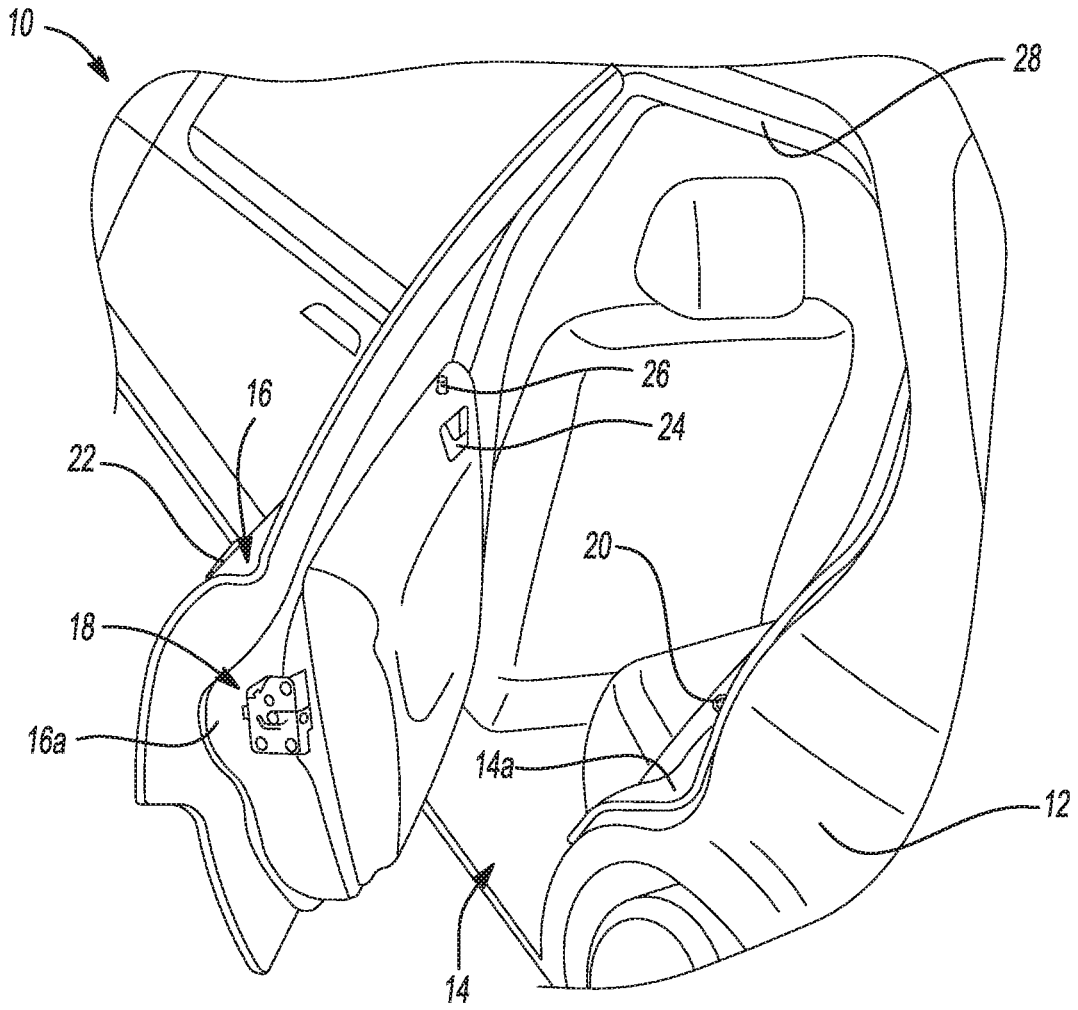
FIG. 1 is a partial isometric view of a motor vehicle having a closure panel equipped with a closure latch assembly that is structurally and functionally configured in accordance with the teachings of the present disclosure to provide a pop-off sound reduction feature.

Referring initially to FIG. 1 of the drawings, a motor vehicle 10 is shown to include a vehicle body 12 defining an opening 14 providing access to an interior passenger compartment. A closure panel 16 is pivotably mounted to body 12 for movement between an open position (shown) and a fully-closed position to respectively open and close opening 14. A closure latch assembly 18 is rigidly secured to closure panel 16 adjacent to an edge portion 16A thereof and is releasably engageable with a striker 20 that is fixedly secured to a recessed edge portion 14A of opening 14. As will be detailed, closure latch assembly 18 is operable to engage and releasably retain striker 20 when closure panel 16 is moved to its fully-closed position. An outside handle 22 and an inside handle 24 are provided for actuating closure latch assembly 18 to release striker 20 and permit subsequent movement of closure panel 16 to its open position. An optional lock knob 26 is shown which provides a visual indication of the locked state of closure latch assembly 18 and which may also be operable to mechanically change the locked state of a lock mechanism associated with closure latch assembly 18. A weather seal 28 is mounted on edge portion 14A of opening 14 in vehicle body 12 and is adapted to be resiliently compressed upon engagement with a mating sealing surface of closure panel 16 when closure panel 16 is held by closure latch assembly 18 in its fully-closed position so as to provide a sealed interface therebetween which is configured to prevent entry of rain and dirt into the passenger compartment while minimizing audible wind noise. Obviously, weather seal 28 can alternatively be mounted to closure panel 16 and sealed with respect to a mating sealing surface formed on edge portion 14A of opening 14. For purpose of clarity and functional association with motor vehicle 10, closure panel 16 is hereinafter referred to as vehicle door 16. However, as noted previously, the closure panel can also be a liftgate, tailgate, decklid, or the like, without departing from the scope of the subject disclosure.

Referring initially to FIGS. 2A through 2E, closure latch assembly 18 is generally shown to include, in this non-limiting configuration, a latch housing 30, a latch mechanism 32, a power-operated latch release mechanism 34, a manually-operated latch release mechanism 38, and a snow-load mechanism 36. Latch housing 30 is configured to be rigidly secured to edge portion 16A of vehicle door 16 and includes a latch plate 40 and a base plate 102 (FIG. 3A) which together define an entry aperture, commonly referred to as fishmouth slot 42, through which striker 20 travels upon movement of vehicle door 16 toward and away from its closed positions.

Latch mechanism 32 is shown, in this non-limiting example, configured as a single ratchet/pawl arrangement having a ratchet 44 and a pawl 46. Ratchet 44 is mounted via a ratchet pivot pin 48 to latch housing 30 for movement between various distinct positions including a first or "striker release" position, a second or "secondary striker capture" position, and a third of "primary striker capture" position, each better defined hereinafter. A ratchet biasing member, such as a ratchet spring, is schematically shown by arrow 50 and is operable to normally bias ratchet 44 in a striker releasing direction toward its striker release position. Ratchet 44 is configured to include a contoured striker guide slot 52 which terminates in a striker capture pocket 54, a primary latch tooth 56, a secondary latch tooth 58, and a raised cam surface 60.

Pawl 46 of latch mechanism 32 is mounted via a pawl pivot pin 64 to latch housing 30 for movement between various distinct positions including a first or "ratchet releasing" position, a second or "secondary ratchet holding" position, and a third or "primary ratchet holding" position, each better defined hereinafter. A pawl biasing member, such as a pawl spring, is schematically shown by arrow 66 and is operable to normally bias pawl 46 in a ratchet engaging direction toward its primary ratchet holding position. Pawl 46 is configured to include a body segment 68 having a ratchet engaging feature, hereinafter referred to as a pawl latch lug 70, and first and second upstanding pawl release lugs 72 and 74. As will be detailed, pawl latch lug 70 engages cam surface 60 on ratchet 44 when ratchet 44 is located in its striker release position and pawl 46 is located in its ratchet releasing position to establish an "unlatched" operating state for latch mechanism 32. With latch mechanism 32 operating in its unlatched state, vehicle door 16 may be moved to its open position relative to vehicle body 12. Likewise, pawl latch lug 70 engages secondary latch tooth 58 on ratchet 44 when pawl 46 is located in its secondary ratchet holding position so as to hold ratchet 44 in its secondary striker capture position and establish a "secondary latched" operating state for latch mechanism 32. With latch mechanism 32 operating in its secondary latched state, vehicle door 16 is latched in a partially-closed (i.e. soft close) position relative to vehicle body 12. Finally, pawl latch lug 70 engages primary latch tooth 56 on ratchet 44 when pawl 46 is located in its primary ratchet holding position so as to hold ratchet 44 in its primary striker capture position and establish a "primary latched" operating state for latch mechanism 32. With latch mechanism 32 operating in its primary latched state, vehicle door 16 is latched in its fully-closed (i.e. hard close) position relative to vehicle body 12.

With continued reference to FIGS. 2A-2E, power-operated latch release mechanism 34 is shown, in this non-limiting example, mounted within latch plate 40 and configured to generally include an electric power release motor 80 having a motor shaft 82, a reduction gearset 84 driven by motor shaft 82, and a power release cam 86, which together define a power release actuator. Reduction gearset 84 includes a worm 88 having threads meshed with teeth formed on a worm gear 90. Power release cam 86 is a uni-directional arrangement and includes first and second cam lugs 92A, 92B formed on and extending outwardly from worm gear 90. Cam lugs 92A, 92B are configured to selectively engage first pawl release lug 72 on pawl 46 to pivot pawl 46 in a ratchet releasing direction (as indicated by arrow 96 in FIG. 2B) from its primary ratchet holding position into its ratchet releasing position in response to rotation of reduction gearset 84 in a latch releasing direction (as indicated by arrow 98 in FIG. 2B) caused by actuation of the power release actuator to provide a power latch release operation. Thus, the power latch release operation functions to shift latch mechanism 32 from its primary latched operating state into its unlatched operating state. Obviously, the power latch release operation can also be used to shift latch mechanism 32 from its secondary latched state into its unlatched state when door 16 is latched in its partially-closed position.

As also shown in FIGS. 2A-2E, closure latch assembly 18 is equipped with manually-operated latch release mechanism 38 which is configured to move pawl 46, directly or indirectly, from its primary ratchet holding position (or its secondary ratchet holding position) into its ratchet releasing position for shifting latch mechanism 32 into its unlatched operating state. Manually-operated latch release mechanism 38 is schematically shown to generally include a manually-actuated device 99 interconnected to pawl 46 via a connection mechanism 101. Manually-actuated device 99 can include any apparatus configured to cause connection mechanism 101 to move pawl 46 to its ratchet releasing position in response to an input action from the user such as, for example, actuation of inside door handle 24 or outside door handle 22 and the like. Connection mechanism 101 is configured to convert the input action exerted by the user on manually-actuated device 99 into a force sufficient to pivot pawl 46 from one of its ratchet holding positions into its ratchet releasing position and may include, for example, cables, linkages, rods and the like.

Figure 2A:
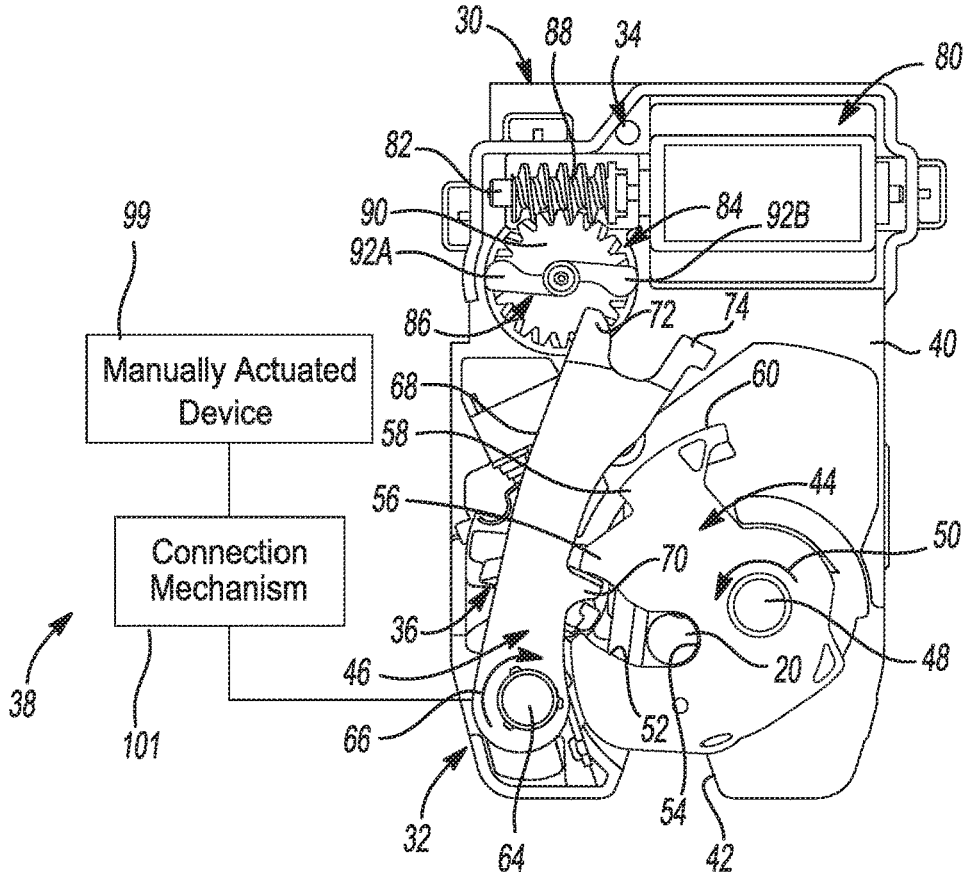
FIGS. 2A through 2E are a series of sequential views illustrating the movement of various components of a latch mechanism, a snowload mechanism, and a power-operated latch release mechanism associated with the closure latch assembly of the present disclosure during a power latch release operation.

FIG. 2A shows latch mechanism 32 in its primary latched operating state with pawl 46 located in its primary ratchet holding position such that pawl latch lug 70 engages primary latch tooth 56 on ratchet 44 for mechanically holding ratchet 44 in its primary striker capture position in opposition to the biasing of ratchet spring 50. In this operating state of latch mechanism 32, vehicle door 16 is held in its fully-closed position. Note that power release cam 86 is located in a home position with cam lugs 92A, 92B displaced from engagement with either of pawl release lugs 72, 74.

Figure 2B:
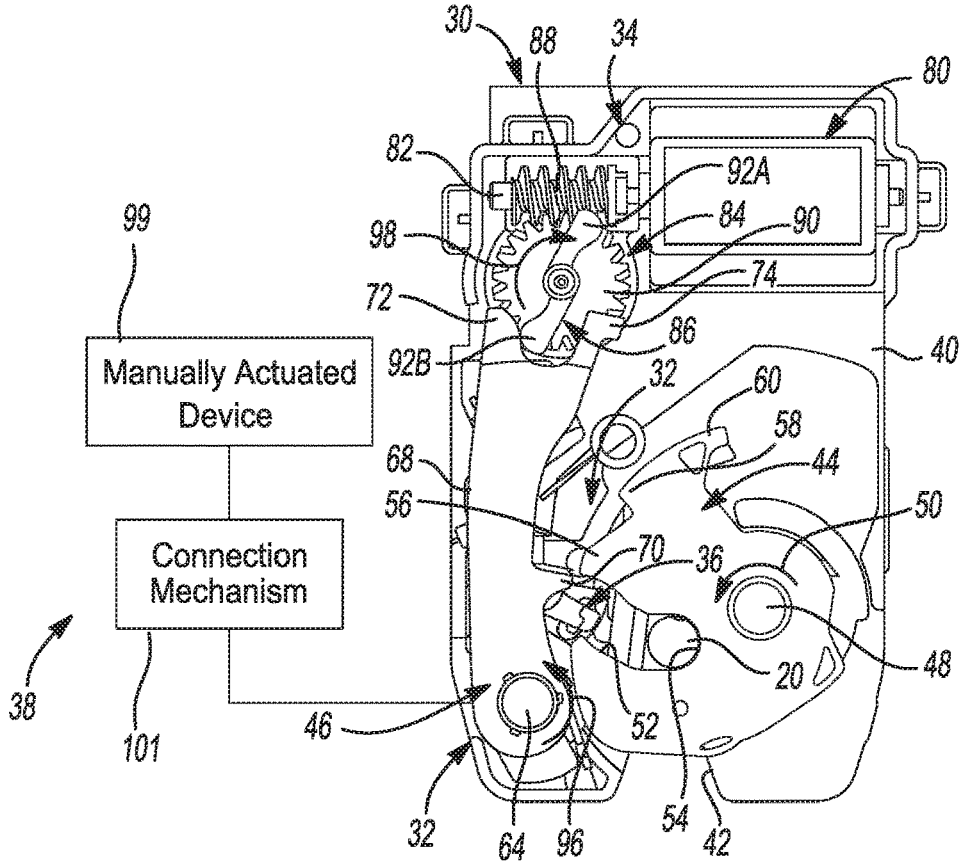

FIG. 2B shows initiation of the power latch release operation with rotation of power release gear 90 in its latch releasing direction causing cam lug 92B to engage first pawl release lug 72 and forcibly pivot pawl 46 in its ratchet releasing direction, in opposition to the biasing of pawl spring 66, from its primary ratchet holding position toward its ratchet releasing position.

Figure 2C:
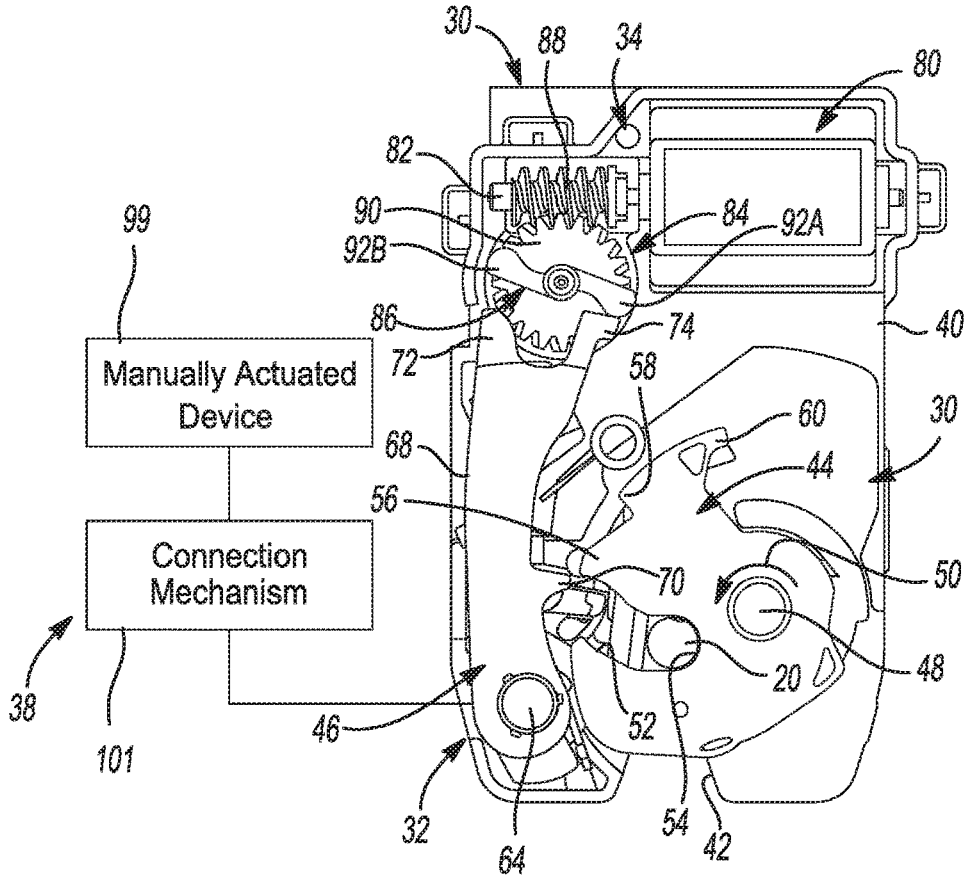

FIG. 2C shows completion of the power latch release operation with pawl 46 located in its ratchet releasing position with cam lug 92A engaging second pawl release lug 74 while power release cam 86 is located in its stop/home position. As will be detailed in reference to FIGS. 3A-3C hereinafter, full travel movement of pawl 46 from its primary ratchet holding position (FIG. 2A) to its ratchet releasing position (FIG. 2C) results in snowload mechanism 36 shifting from a non-engaged state (FIGS. 2A and 3A) into an engaged state (FIGS. 2C and 3B) for mechanically holding pawl 46 in its ratchet releasing position. Snowload mechanism 36 is subsequently shifted back into its non-engaged state (FIGS. 2D and 3C) in response to movement of ratchet 44 past its secondary striker capture position so as to release pawl 46 for movement toward ratchet 44.

Figure 2D:
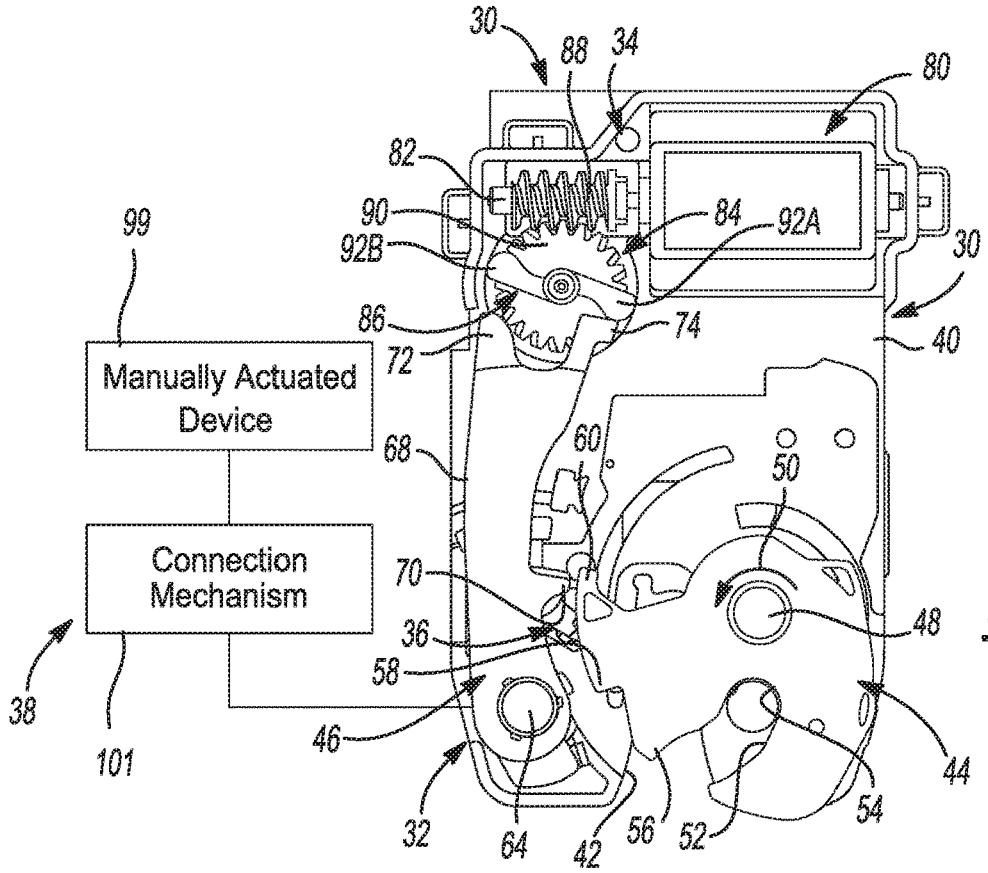
Figure 2E:
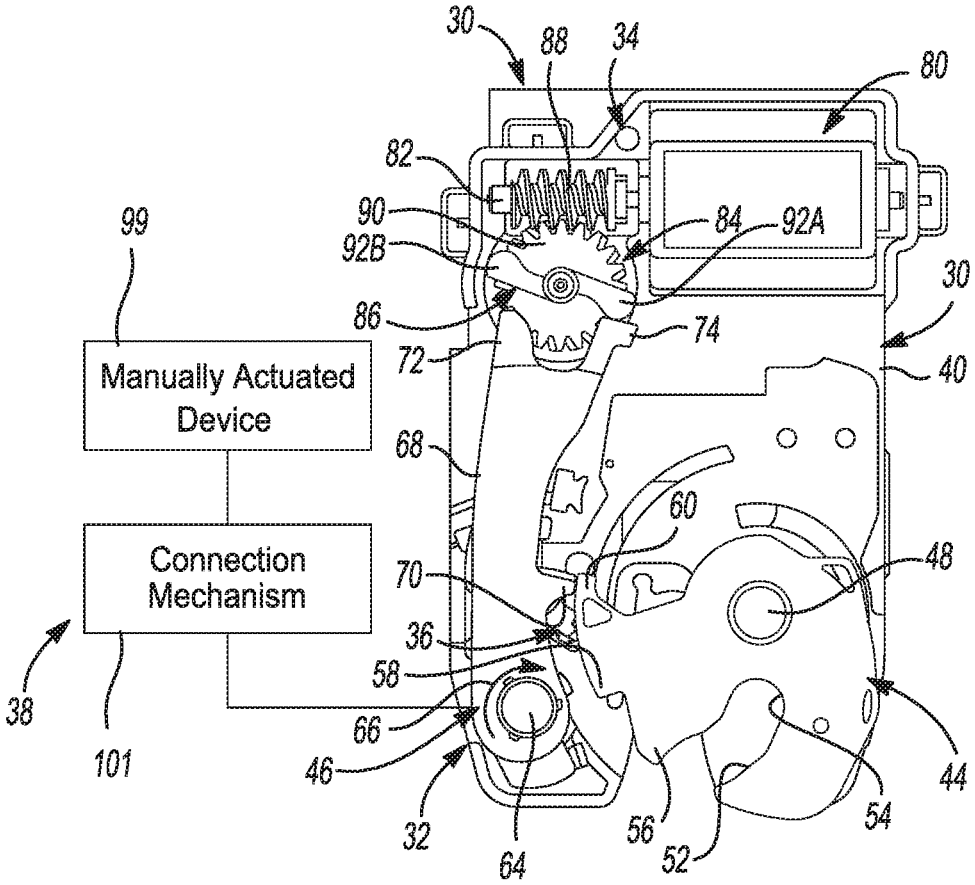

FIG. 2D shows latch mechanism 32 in its unlatched operating state as snowload mechanism 36 is shifted back to its non-engaged state with pawl latch lug 70 slightly displaced from engagement with cam surface 60 while cam lug 92A continues to engage second pawl release lug 74. FIG. 2E shows ratchet 44 rotated completely to its striker release position and illustrates pawl latch lug 70 engaging raised cam surface 60 on ratchet 44 while cam lug 92A has slid along in continued engagement with second pawl release lug 74. In the positions shown in both FIGS. 2D and 2E, power release cam 86 is prevented from further rotation in the latch releasing direction. With ratchet 44 located in its striker release position, latch mechanism 32 is operating in its unlatched state for allowing vehicle door 16 to be moved from its fully-closed position to its open position.

Figure 3A:
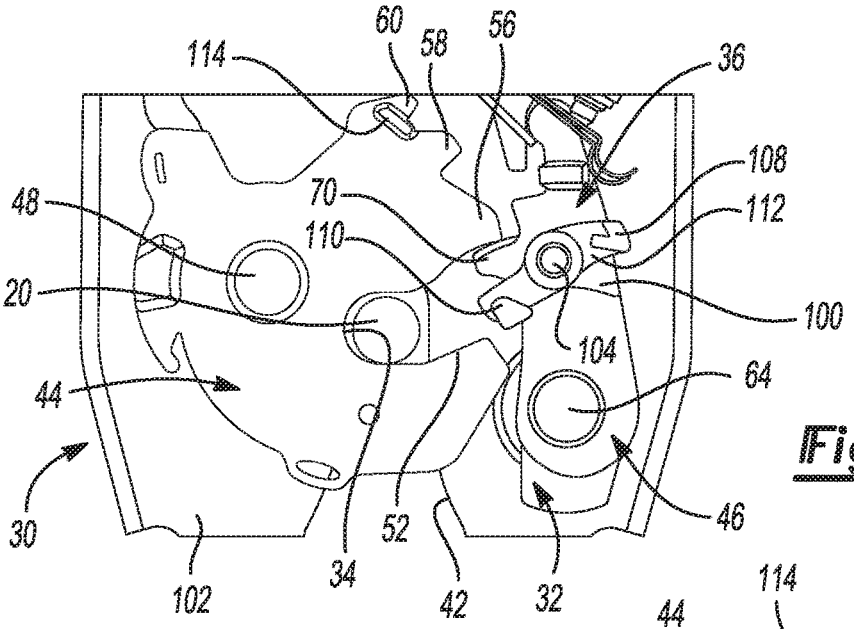
FIGS. 3A through 3C are another series of sequential views for illustrating the interaction between the components of the latch mechanism and the snowload mechanism associated with the closure latch assembly of the present disclosure during the power latch release operation.
Figure 3B:
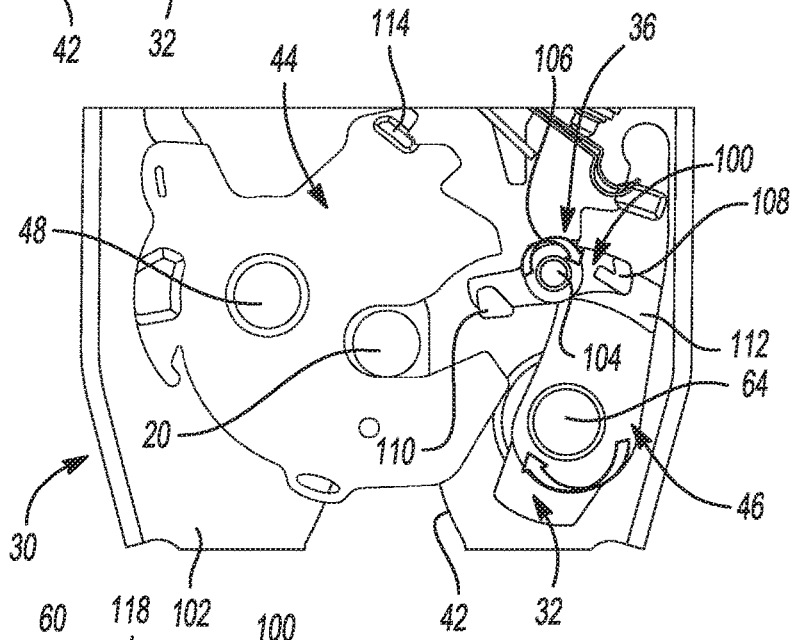
Figure 3C:
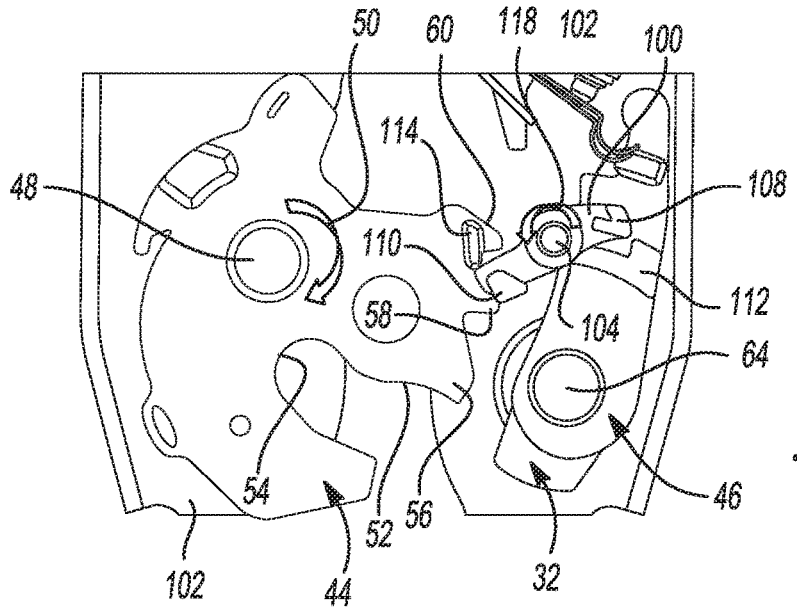

Referring now to FIGS. 3A-3C, the functional operation of snowload mechanism 36 will now be described in greater detail. Snowload mechanism 36 generally includes a snowload lever 100 pivotably mounted to base plate 102 of latch housing 30 via a snowload lever pivot pin 104, and a snowload lever biasing member, such as a snowload lever spring, schematically shown by arrow 106. Snowload lever 100 includes a latch lug 108 and a release lug 110 and is shown in FIG. 3A biased by snowload lever spring 106 toward a first or "pawl engaged" position. Latch mechanism 32 is shown in FIG. 3A operating in its primary latched state with latch lug 70 on pawl 46 engaging primary latch tooth 56 on ratchet 44 such that pawl 46 is located in its primary ratchet holding position for holding ratchet 44 in its primary striker capture position. As such, latch lug 108 on snowload lever 100 is disengaged from a latching feature, such as a latch tooth 112, formed on body segment 68 of pawl 46 such that snowload mechanism 36 is operating in its non-engaged state. FIG. 3B illustrates that movement of pawl 46 to its ratchet releasing position results in latch lug 108 on snowload lever 100 being biased into its pawl engaged position for latched engagement with latch tooth 112 on pawl 46, thereby mechanically holding pawl 46 in its ratchet releasing position so as to establish the engaged operating state of snowload mechanism 36. FIG. 3C illustrates that subsequent rotation of ratchet 44 in its releasing direction causes a release lug 114 on ratchet 44 to engage release lug 110 on snowload lever 100 and forcibly rotate snowload lever 100 from its pawl engaged position into a second or "pawl disengaged" position (as indicated by arrow 118), in opposition to the biasing of snowload lever spring 106, such that latch lug 108 on snowload lever 100 disengages latch tooth 112 on pawl 46. Release of latch lug 108 from engagement with latch tooth 112 permits pawl spring 66 to urge pawl 46 to rotate back towards its primary ratchet holding position. However, this shifting of snowload mechanism 36 back into its disengaged state only occurs after ratchet 44 has rotated past its secondary striker capture position, thereby assuring no unintended latching of latch mechanism 32 in its secondary latched state.

Figure 4A:
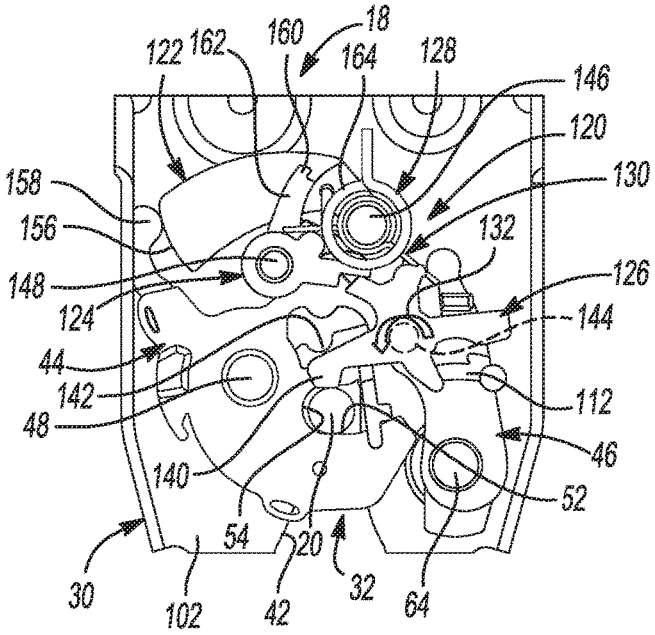
FIGS. 4A through 4C are a series of sequential views illustrating the movement of various components of the latch mechanism and a pop-off sound reduction mechanism associated with the closure latch assembly of the present disclosure during the power latch release operation.
Figure 4B:
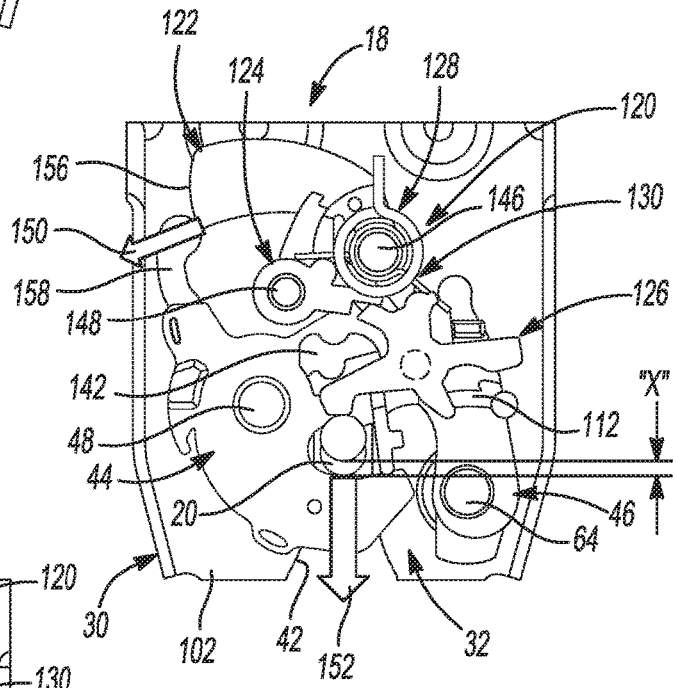
Figure 4C:
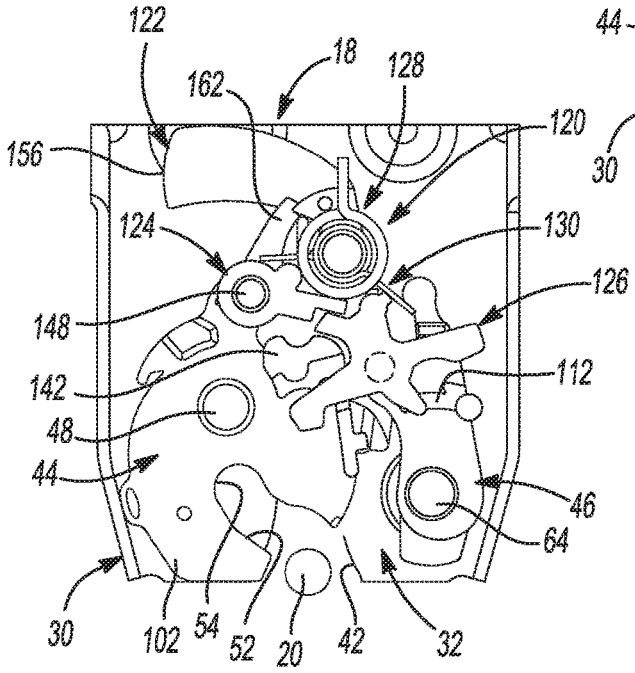

With particular reference now to FIGS. 4A through 4C, closure latch assembly 18 is further shown to include a pop-off sound reduction ("POSR") mechanism 120 that is operably associated with latch mechanism 32 and which is configured to exert a resistive load on ratchet 44 arranged to counteract the seal load exerted by striker 20 on ratchet 44 for the purpose of reducing the exit velocity and exit acceleration characteristics of striker 20 as it exits closure latch assembly 18. The seal load is generated by compression of weather seal 28 when vehicle door 16 is latched in its fully-closed position. This resistive force, which is counteractive against the conventional opening forces, functions to prevent or significantly limit the audible latch "pop-off" sound generated upon initially shifting latch mechanism 32 into its unlatched operating state. In this regard, POSR mechanism 120 can be added to any traditional single ratchet/pawl or double ratchet/pawl latch mechanism configuration and its association with latch mechanism 32 is non-limiting and for purposes of illustration of one such exemplary interactive arrangement.

POSR mechanism 120 is generally configured to include an auxiliary pawl 122, a memory lever 124, a striker lever 126, an auxiliary pawl spring 128, a memory lever spring 130, and a striker lever spring 132.

FIG. 4A illustrates latch mechanism 32 in its primary latched state with pawl 46 located in its primary ratchet holding position for holding ratchet 44 in its primary striker capture position. With ratchet 44 held in its primary striker capture position, striker 20 engages an edge portion of striker capture pocket 54 and a striker lug segment 140 of striker lever 126. In turn, striker lug segment 140 on striker lever 126 is shown in engagement with a resilient overslam bumper 142. As such, striker lever 126 interfaces between striker 20 and overslam bumper 142. This interface arrangement provides consistent bumper loads and engagement effort regardless of potential striker misalignment.

Striker lever 126 is mounted to latch housing 30 for movement about a striker lever pivot pin 144 (shown in phantom) between a first or "striker engaged" position (FIG. 4A) and a second or "striker disengaged" position (FIG. 4C). Striker lever spring 132 is shown schematically and is arranged to normally bias striker lever 126 toward its striker disengaged position. Auxiliary pawl 122 is mounted to latch housing 30 for movement about an auxiliary pawl pivot post 146 between a first or "ratchet engaged" position (FIG. 4A) and a second or "ratchet disengaged" position (FIG. 4C). Auxiliary pawl spring 128 is operably arranged to normally bias auxiliary pawl 122 toward its ratchet engaged position. Finally, memory lever 124 is mounted to latch housing 30 for movement about a memory lever pivot post 148 between a first or "auxiliary pawl release" position (FIG. 5C) and a second or "auxiliary pawl hold" position (FIG. 4C). Memory lever spring 130 acts on memory lever 124 for normally biasing memory lever 124 toward its auxiliary pawl hold position.

FIGS. 4A-4C illustrate a sequential series of views showing movement of the components of POSR mechanism 120 and latch mechanism 32 during a latch release or door opening function during which latch mechanism 32 is shifted from its primary latched state (FIG. 4A) into its unlatched state (FIG. 4C). Prior to initiation of this door opening function, POSR mechanism 120 is configured to exert the resistive force on ratchet 44 (as indicated by arrow 150 in FIG. 4B) which, as noted, is oriented to counteract the seal load (indicated by arrow 152 in FIG. 4B) applied to ratchet 44 via striker 20. In particular, POSR mechanism 120 is shown in FIG. 4A in an "engaged" state with a cam surface 156 formed on an outer edge portion of auxiliary pawl 122 engaging a ratchet extension segment 158 formed on ratchet 44 when ratchet 44 is located in its primary striker capture position (held by pawl 46 located in its primary ratchet holding position) and auxiliary pawl 122 is located in its ratchet engaged position. Upon movement of pawl 46 to its ratchet releasing position (via actuation of power-operated latch release mechanism 34 or operation of manually-operated latch release mechanism 38), initial rotation of ratchet 44 toward its striker release position (FIG. 4B) causes ratchet extension segment 158 to cam against cam surface 156 on auxiliary pawl 122 and forcibly pivot auxiliary pawl 122 about its pivot post 146 from its ratchet engaged position toward its ratchet disengaged position, in opposition to the biasing exerted thereon by auxiliary pawl spring 128. Cam surface 156 is configured to include a "positive back-out" contour or profile providing a limited amount of continuous engagement with ratchet extension segment 158 of ratchet 44 during a predetermined amount of striker travel (indicated by dimension "x" in FIG. 4B). This positive back-out profile feature is designed so that a portion of seal load 152 conventionally used to accelerate striker 20 out of ratchet 44 is now used to pivot auxiliary pawl 122 out of engagement with ratchet 44 in the form of resistive force 150. As a result, the exit acceleration and velocity characteristics of striker 20 upon release of latch mechanism 32 are significantly reduced by POSR mechanism 120. Resistive force 150 is exerted on ratchet 44 for the predetermined striker travel "x" during which the seal loads associated with compressed weather seal 28 (FIG. 1) are the highest. In a non-limiting example, the striker distance "x" can be in a range of 1.5-3.5 mm of travel and, more preferably, is about 2.2 mm. However, other predetermined amounts of striker travel "x" (associated with an initial amount of rotation of ratchet 44) can be utilized without departing from the scope of the subject disclosure.

Prior to disengagement of ratchet extension segment 158 from cam surface 156, the interaction therebetween functions to move auxiliary pawl 122 to its ratchet disengaged position whereat a latch tooth 160 formed on a leg segment 162 of memory lever 124 engages a latch lug segment 164 formed on auxiliary pawl 122, as is best shown in FIG. 4C. Thus, memory lever 124 is operable in its auxiliary pawl hold position to mechanically hold auxiliary pawl 122 in its ratchet disengaged position. FIG. 4C illustrates ratchet 44 located in its striker release position, pawl 46 located in its ratchet releasing position, striker lever 126 located in its striker disengaged position, memory lever 124 located in its auxiliary pawl hold position, and auxiliary pawl 122 located in its ratchet disengaged position upon completion of the latch opening function and as vehicle door 16 is moved toward its open position.

Figure 5A:
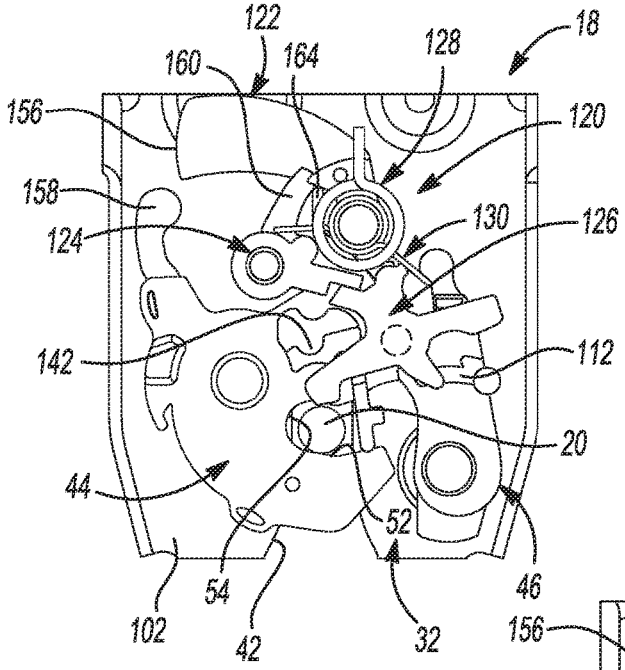
FIGS. 5A through 5D are another series of sequential views illustrating the movement of various components of the latch mechanism and the pop-off sound reduction mechanism associated with closure latch assembly of the present disclosure during a latch closing operation.
Figure 5B:
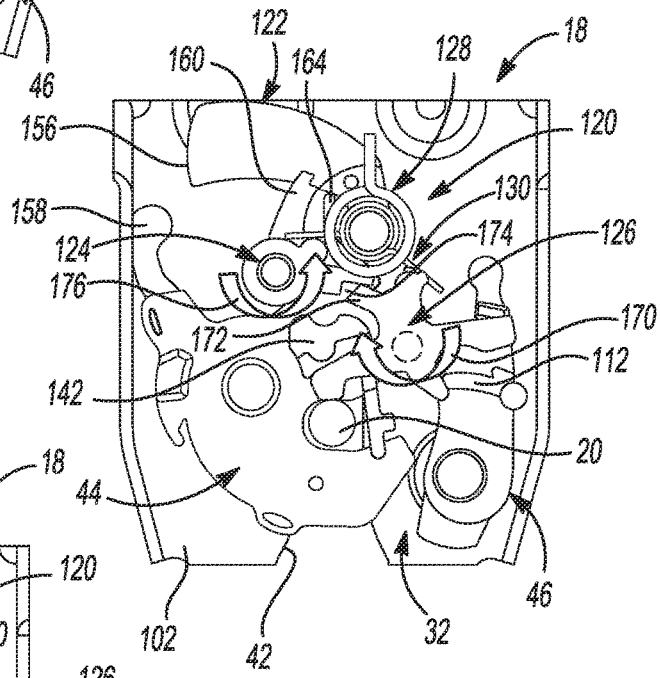
Figure 5C:
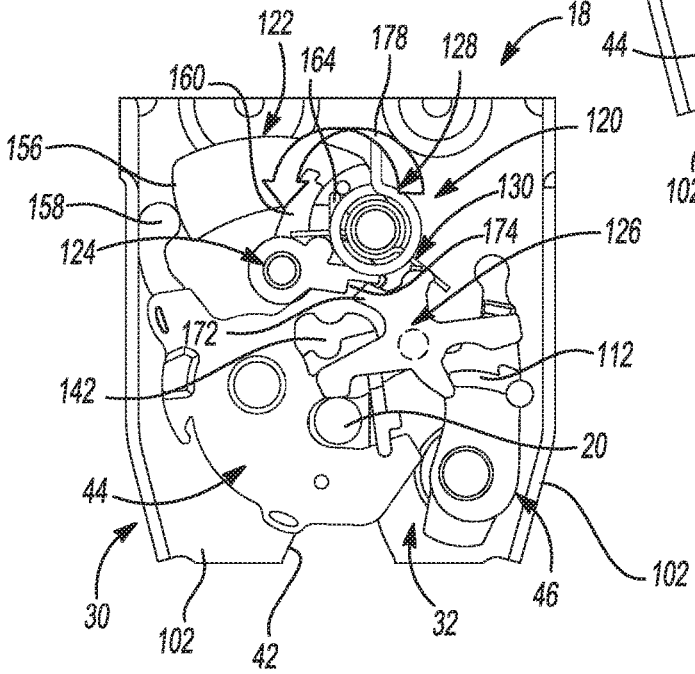
Figure 5D:
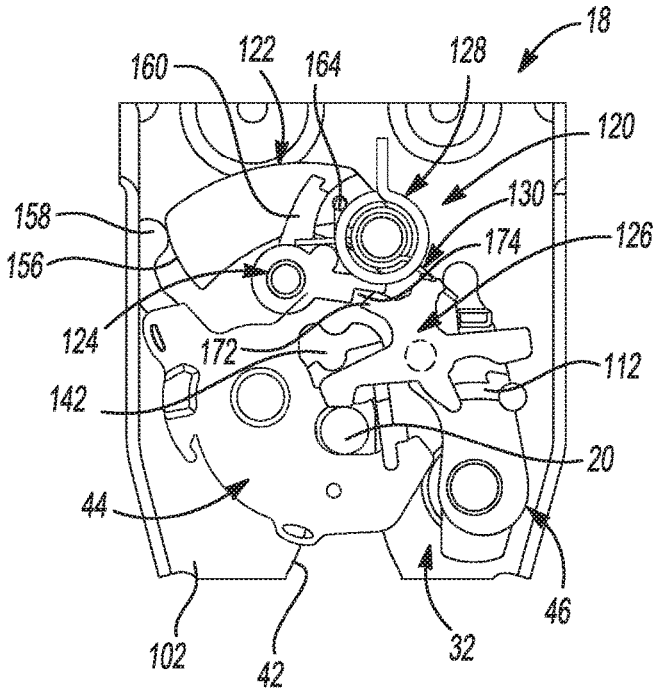

FIGS. 5A through 5D illustrate a sequential series of views showing movement of the components of POSR mechanism 120 and latch mechanism 32 during a latch closing function caused in response to vehicle door 16 moving into its fully-closed position and which results in shifting of latch mechanism 32 into its primary latched state and shifting of POSR mechanism 120 into its engaged state. In particular, FIG. 5A illustrates striker 20 engaging and forcibly rotating ratchet 44 in a latching direction due to engagement of striker 20 with striker guide slot 52 as ratchet 44 approaches its primary striker capture position. FIG. 5B illustrates that continued rotation of ratchet 44 in its latching direction results in striker 20 engaging striker lever 126 and causing striker lever 126 to pivot about its pivot pin 144 and move from its striker disengaged position into its striker engaged position, as indicated by arrow 170. Such movement of striker lever 126 causes a striker lever lug 172 formed thereon to engage a memory lever lug 174 formed on memory lever 124, thereby forcibly rotating memory lever 124 from its auxiliary pawl holding position toward its auxiliary pawl released position, as indicated by arrow 176. FIG. 5C illustrates that such movement of memory lever 124 results in latch tooth 160 on leg segment 162 of memory lever 124 disengaging latch lug segment 164 on auxiliary pawl 122, thereby allowing auxiliary pawl spring 128 to forcibly move auxiliary pawl 122 from its ratchet disengaged position (FIG. 5B) toward its ratchet engaged position, as indicated by arrow 178. As seen, cam surface 156 of auxiliary pawl 122 is now engaged with ratchet extension 158 on ratchet 44. Finally, FIG. 5D illustrates ratchet 44 located in its primary striker capture position, pawl 46 located in its primary ratchet holding position, striker lever 126 located in its striker engaged position, memory lever 124 located in its auxiliary pawl released position, and auxiliary pawl 122 located in its ratchet engaged position. As such, latch mechanism 32 is now operating it its primary latched state and POSR mechanism 120 is now operating in its engaged state upon completion of the latch closing function.

Figure 6:
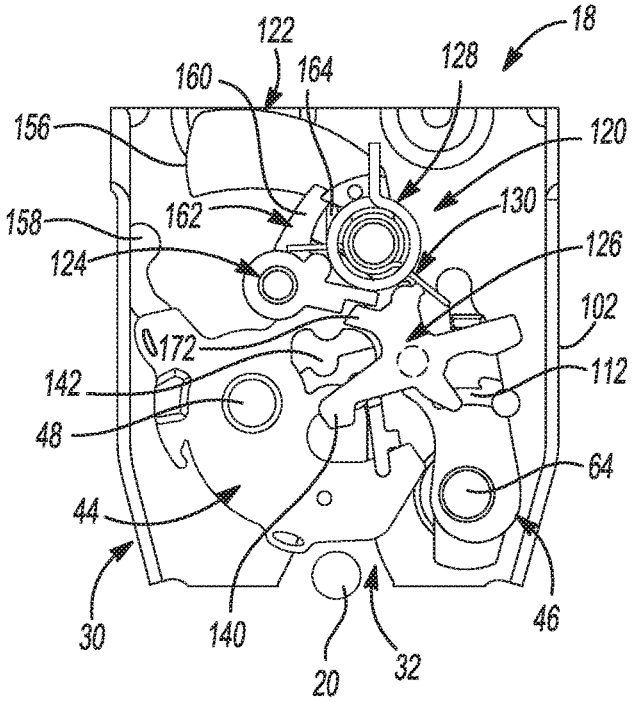
FIG. 6 is another view of the interaction between the components of the latch mechanism and the pop-off sound reduction mechanism associated with the closure latch assembly of the present disclosure during a manual latch reset operation.

FIG. 6 illustrates the situation where ratchet 44 is moved to its primary striker capture position (or secondary striker capture position) without engagement with striker 20, such as possibly during a service action or unintended release of latch mechanism 32. As seen, POSR mechanism 120 remains in its disengaged state with striker lever 126 located in its striker released position, memory lever 124 located in its auxiliary pawl hold position, and auxiliary pawl 122 located in its ratchet disengaged position. As such, the resistive load of POSR mechanism 120 is not exerted on ratchet 44 so as to allow latch mechanism 32 to be unlatched normally.

FIG. 7 is an example plot of striker exit velocities at different levels (%) of seal loads measured against time for a conventional latch mechanism without POSR mechanism 120. In comparison, FIG. 8 is a similar example plot of striker exit velocities for closure latch assembly 18 having POSR mechanism 120. As is evident, POSR mechanism 120 provides a significant reduction (approximately 27%) in the striker exit velocity which is equivalent to a reduction of about 200 N in the seal load. FIGS. 9 and 10 provide a similar example comparison of striker acceleration characteristic for a closure latch assembly without a POSR mechanism (FIG. 9) and closure latch assembly 18 with POSR mechanism 120 (FIG. 10) illustrating a significant reduction (approximately 40%) in the striker exit acceleration which is equivalent to a seal load reduction of about 300 N.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A closure latch assembly for a closure panel mounted to a motor vehicle for movement between an open position and closed position, the closure latch assembly comprising:

a latch mechanism having a ratchet and a pawl, the ratchet being moveable between a striker release position whereat the ratchet is positioned to receive a striker and a striker capture position whereat the ratchet is positioned to retain the striker, the ratchet being biased toward its striker release position, the pawl being moveable between a ratchet releasing position whereat the pawl is positioned to permit the ratchet to move to its striker release position and a ratchet holding position whereat the pawl is positioned to hold the ratchet in its striker capture position, the pawl being biased toward its ratchet holding position; and a pop-off sound reduction mechanism having an auxiliary pawl and a striker lever, the auxiliary pawl being moveable between a ratchet disengaged position whereat the auxiliary pawl is disengaged from the ratchet and a ratchet engaged position whereat the auxiliary pawl is engaged with the ratchet, the auxiliary pawl being biased toward its ratchet engaged position, the striker lever being moveable between a striker disengaged position whereat the auxiliary pawl is held in its ratchet disengaged position and a striker engaged position whereat the auxiliary pawl is permitted to move to its ratchet engaged position, the striker lever being biased toward its striker disengaged position, wherein the striker lever moves from its striker disengaged position into its striker engaged position in response to the striker engaging and moving the ratchet from its striker release position into its striker capture position, wherein a striker exit force exerted on the ratchet by contact with the striker when the ratchet is located in its striker capture position is counteracted by a resistive force exerted on the ratchet by contact with the auxiliary pawl as the ratchet is moving away from its striker capture position and as the auxiliary pawl is moved from its ratchet engaged position to its ratchet disengaged position in response to movement of the ratchet moving away from its striker capture position.

2. The closure latch assembly of claim 1, wherein the latch mechanism is operable in a latched state when the pawl is located in its ratchet holding position for holding the ratchet in its striker capture position, and wherein the latch mechanism is further operable in an unlatched state when the pawl is moved to its ratchet releasing position for permitting movement of the ratchet to its striker release position.

3. The closure latch assembly of claim 2 further comprising a latch release mechanism for moving the pawl from its ratchet holding position to its ratchet releasing position to shift the latch mechanism from its latched state into its unlatched state.

4. The closure latch assembly of claim 3, wherein the latch release mechanism includes a power-operated release actuator operable for moving the pawl to its ratchet releasing position to provide the closure latch assembly with a power latch release function.

5. The closure latch assembly of claim 3 wherein the latch release mechanism is manually-operated for moving the pawl to its ratchet releasing position in response to an input action from a user.

6. The closure latch assembly of claim 2, wherein the pop-off sound reduction mechanism is operable in an engaged state when the striker lever is moved by the striker to its striker engaged position and the auxiliary pawl is moved to its ratchet engaged position, and wherein the pop-off sound reduction mechanism is operable in a disengaged state when the striker lever is located in its striker disengaged position and the auxiliary pawl is held in its ratchet disengaged position.

7. The closure latch assembly of claim 6, wherein an auxiliary pawl spring biases the auxiliary pawl toward its ratchet engaged position, and wherein when the latch mechanism is in its latched state and the pop-off sound reduction mechanism is in its engaged state the auxiliary pawl spring and the auxiliary pawl apply the resistive force to the ratchet via contact with the auxiliary pawl such that subsequent movement of the pawl to its ratchet releasing position acts to shift the latch mechanism into its unlatched mode for causing the ratchet to forcibly move the auxiliary pawl from its ratchet engaged position into its ratchet disengaged position in response to movement of the ratchet toward its striker release position so as to shift the pop-off sound reduction mechanism into its disengaged state.

8. The closure latch assembly of claim 7, wherein the pop-off sound reduction mechanism further includes a memory lever moveable between an auxiliary pawl released position and an auxiliary pawl hold position, the memory lever being biased toward its auxiliary pawl hold position, wherein movement of the striker lever from its striker disengaged position into its striker engaged position causes the memory lever to move from its auxiliary pawl hold position to its auxiliary pawl released position for permitting the auxiliary pawl to move from its ratchet disengaged position into its ratchet engaged position, and wherein movement of the ratchet from its striker capture position toward its striker release position causes the auxiliary pawl to move from its ratchet engaged position to its ratchet disengaged position, and wherein the memory lever is operable in its auxiliary pawl hold position to hold the auxiliary pawl in its ratchet disengaged position.

9. The closure latch assembly of claim 8, wherein the ratchet includes a ratchet extension segment configured to engage a cam surface on the auxiliary pawl when the ratchet is located in its striker capture position and the auxiliary pawl is located in its ratchet engaged position, and wherein the cam surface includes a positive back-out profile configured to generate the resistive force via contact with the ratchet extension when the ratchet is initially released for movement toward its striker release position which causes movement of the auxiliary pawl from its ratchet engaged position to its ratchet disengaged position in opposition to the biasing of the auxiliary pawl spring.

10. The closure latch assembly of claim 1, wherein the pop-off sound reduction mechanism further includes a memory lever moveable between an auxiliary pawl released position and an auxiliary pawl hold position, the memory lever being biased toward its auxiliary pawl hold position, wherein movement of the striker lever from its striker disengaged position into its striker engaged position causes the memory lever to move from its auxiliary pawl hold position to its auxiliary pawl released position for permitting the auxiliary pawl spring to forcibly move the auxiliary pawl from its ratchet disengaged position into its ratchet engaged position, and wherein movement of the ratchet from its striker capture position toward its striker release position causes the auxiliary pawl to move from its ratchet engaged position to its ratchet disengaged position, and wherein the memory lever is operable in its auxiliary pawl hold position to hold the auxiliary pawl in its ratchet disengaged position.

11. The closure latch assembly of claim 1, wherein the latch mechanism includes a ratchet spring biasing the ratchet toward its striker release position, wherein the pop-off sound reduction mechanism includes an auxiliary pawl spring biasing the auxiliary pawl toward its ratchet engaged position, wherein the ratchet has a ratchet extension engaging a cam surface on the auxiliary pawl when the ratchet is located in its striker capture position and the auxiliary pawl is located in its ratchet engaged position, and wherein the ratchet extension engages the cam surface during a predefined amount of travel of the ratchet moving from its striker capture position toward its striker release position during which the resistive force is exerted on the ratchet by contact with the auxiliary pawl.

12. The closure latch assembly of claim 11, wherein after the predefined amount of travel of the ratchet, the ratchet extension disengages the cam surface on the auxiliary pawl and the auxiliary pawl is held in its ratchet disengaged position.

13. The closure latch assembly of claim 12, wherein the pop-off sound reduction mechanism further includes a memory lever moveable between an auxiliary pawl released position and an auxiliary pawl hold position, the memory lever being biased toward its auxiliary pawl hold position, wherein movement of the striker lever from its striker disengaged position into its striker engaged position causes the memory lever to move from its auxiliary pawl hold position to its auxiliary pawl released position for permitting the auxiliary pawl spring to forcibly move the auxiliary pawl from its ratchet disengaged position into its ratchet engaged position, and wherein movement of the ratchet from its striker capture position toward its striker release position causes the auxiliary pawl to move from its ratchet engaged position to its ratchet disengaged position, and wherein the memory lever is operable in its auxiliary pawl hold position to hold the auxiliary pawl in its ratchet disengaged position.

14. A closure latch assembly, comprising:

a ratchet moveable between a striker release position whereat the ratchet is positioned to receive a striker and a striker capture position whereat the ratchet is positioned to retain the striker;

a ratchet spring for biasing the ratchet toward its striker release position;

a pawl moveable between a ratchet holding position whereat the pawl is positioned to hold the ratchet in its striker capture position and a ratchet releasing position whereat the pawl is positioned to permit the ratchet to move toward its striker release position;

a pawl spring for biasing the pawl toward its ratchet holding position;

an auxiliary pawl moveable between a ratchet engaging position whereat a cam surface on the auxiliary pawl engages a ratchet segment of the ratchet and a ratchet disengaging position whereat the cam surface is disengaged from the ratchet segment;

an auxiliary pawl spring biasing the auxiliary pawl toward its ratchet engaged position;

a memory lever moveable between an auxiliary pawl hold position whereat the memory lever is positioned to hold the auxiliary pawl in its ratchet disengaged position and an auxiliary pawl released position whereat the memory lever is positioned to permit the auxiliary pawl to move to its ratchet engaged position;

a memory lever spring biasing the memory lever toward its auxiliary pawl hold position;

a striker lever moveable between a striker disengaged position whereat the striker lever permits the memory lever to be positioned in its auxiliary pawl hold position and a striker engaged position whereat the striker lever moves the memory lever to its auxiliary pawl released position; and a striker lever spring biasing the striker lever toward its striker disengaged position, wherein the striker lever moves from its striker disengaged position to its striker engaged position in response to the striker engaging and moving the ratchet from its striker release position into its striker capture position, wherein a striker exit force exerted by the striker via contact on the ratchet when the ratchet is held in its striker capture position is counteracted by a resistive force exerted by the auxiliary pawl spring via contact between the cam surface on the auxiliary pawl and the ratchet segment on the ratchet when the auxiliary pawl is located in its ratchet engaged position.

15. The closure latch assembly of claim 14, wherein a latched state is established between the ratchet and the pawl when the pawl is located in its ratchet holding position for holding the ratchet in its striker capture position, wherein an unlatched state is established between the ratchet and the pawl when the pawl is moved to its ratchet releasing position, wherein an engaged state is established between the ratchet and the auxiliary pawl when the ratchet is located in its striker capture position and the auxiliary pawl is located in its ratchet engaging position, wherein a disengaged state is established between the ratchet and the auxiliary pawl when the ratchet moves a predetermined distance from its striker capture position toward its striker release position which causes the auxiliary pawl to move from its ratchet engaged position to its ratchet disengaged position in opposition to the biasing of the auxiliary pawl spring, and wherein the resistive force is applied to the ratchet via contact with the auxiliary pawl during the predetermined distance required to shift into the unlatched and disengaged states.

16. The closure latch assembly of claim 15, further comprising a latch release mechanism for moving the pawl from its ratchet holding position into its ratchet releasing position for establishing the unlatched state and initiating a shift from the engaged state to the disengaged state.

17. The closure latch assembly of claim 15, wherein the striker lever has a striker lug engageable with the striker as the striker moves the ratchet toward its striker capture position and which functions to forcibly pivot the striker lever toward its striker engaged position, wherein the striker lever engages the memory lever such that pivotal movement of the striker lever to its striker engaged position causes pivotal movement of the memory lever to its auxiliary pawl released position, and wherein the memory lever engages the auxiliary pawl such that pivotal movement of the memory lever to its auxiliary pawl released position causes pivotal movement of the auxiliary pawl to its ratchet engaged position so as to establish the latched and engaged states.

18. The closure latch assembly of claim 15, wherein the cam surface on the auxiliary pawl has a positive back-out profile configured to generate the resistive force via contact with the ratchet as the auxiliary pawl is moved by the ratchet from its ratchet engaged position to its ratchet disengaged position.

19. A closure latch assembly for a closure panel mounted to a motor vehicle for movement between an open position and closed position, the closure latch assembly comprising:

a latch mechanism having a ratchet and a pawl, the ratchet being moveable between a striker release position whereat the ratchet is positioned to receive a striker and a striker capture position whereat the ratchet is positioned to retain the striker, the ratchet being biased toward its striker release position, the pawl being moveable between a ratchet releasing position whereat the pawl is positioned to permit the ratchet to move to its striker release position and a ratchet holding position whereat the pawl is positioned to hold the ratchet in its striker capture position, the pawl being biased toward its ratchet holding position; and a ratchet motion reduction mechanism having an auxiliary pawl being moveable between a ratchet disengaged position whereat the auxiliary pawl is disengaged from the ratchet and a ratchet engaged position whereat the auxiliary pawl is engaged with the ratchet, the auxiliary pawl being biased toward its ratchet engaged position, wherein a striker exit force exerted on the ratchet by contact with the striker when the ratchet is located in its striker capture position is counteracted by a resistive force exerted on the ratchet by contact with the auxiliary pawl as the ratchet is moving away from its striker capture position and as the auxiliary pawl is moved from its ratchet engaged position to its ratchet disengaged position in response to movement of the ratchet from its striker capture position to its striker release position.

20. The closure latch assembly of claim 19, wherein the ratchet includes a ratchet extension segment configured to engage a cam surface on the auxiliary pawl when the ratchet is located in its striker capture position and the auxiliary pawl is located in its ratchet engaged position, wherein the resistive force from contact of the auxiliary pawl counteracts a cam-out force from contact of the ratchet extension segment on the cam surface.

21. The closure latch assembly of claim 20, wherein the auxiliary pawl is rotatable about an auxiliary pawl axis, and wherein the cam surface includes a positive cam-out profile configured to generate a rotation of the auxiliary pawl as the ratchet extension segment engages the cam surface to move the auxiliary pawl from its ratchet engaged position to its ratchet disengaged position.

22. The closure latch assembly of claim 20, further comprising an auxiliary pawl spring biasing the auxiliary pawl toward its ratchet engaged position, wherein the resistive force from contact of the auxiliary pawl further includes a force exerted by the auxiliary pawl spring on the auxiliary pawl opposing the movement of the auxiliary pawl from its ratchet engaged position to its ratchet disengaged position.

23. The closure latch assembly of claim 19, wherein the auxiliary pawl directly engages the ratchet when the auxiliary pawl is in its ratchet engaged position.

24. The closure latch assembly of claim 1, wherein the auxiliary pawl directly engages the ratchet when the auxiliary pawl is in its ratchet engaged position.

25. A closure latch assembly for a closure panel mounted to a motor vehicle for movement between an open position and closed position, the closure latch assembly comprising:

a latch mechanism having a ratchet and a pawl, the ratchet being moveable between a striker release position whereat the ratchet is positioned to receive a striker and a striker capture position whereat the ratchet is positioned to retain the striker, the ratchet being biased toward its striker release position, the pawl being moveable between a ratchet releasing position whereat the pawl is positioned to permit the ratchet to move to its striker release position and a ratchet holding position whereat the pawl is positioned to hold the ratchet in its striker capture position, the pawl being biased toward its ratchet holding position; and a pop-off sound reduction mechanism having an auxiliary pawl, the auxiliary pawl being moveable between a ratchet disengaged position whereat the auxiliary pawl is disengaged from the ratchet and a ratchet engaged position whereat the auxiliary pawl is engaged with the ratchet, the auxiliary pawl being biased toward its ratchet engaged position, wherein a striker exit force exerted on the ratchet by contact with the striker when the ratchet is located in its striker capture position is counteracted by a resistive force exerted on the ratchet by contact with the auxiliary pawl as the ratchet is moving away from its striker capture position and as the auxiliary pawl is moved from its ratchet engaged position to its ratchet disengaged position in response to movement of the ratchet moving away from its striker capture position.

26. The closure latch assembly of claim 25, wherein the auxiliary pawl directly engages the ratchet when the auxiliary pawl is in its ratchet engaged position.

* * * * *